United States Patent [19]

Schmidt

[11] 4,250,972

[45] Feb. 17, 1981

[54] PNEUMATIC RAM BORING DEVICE

[76] Inventor: Paul Schmidt, Postfach 9, 5940 Lennestadt, Fed. Rep. of Germany

[21] Appl. No.: 25,722

[22] Filed: Mar. 30, 1979

[30] Foreign Application Priority Data

May 12, 1978 [DE] Fed. Rep. of Germany ..... 2820785

[51] Int. Cl.[3] ..... E21B 7/26

[52] U.S. Cl. ..... 173/91; 175/19

[58] Field of Search ..... 173/91; 175/19, 92, 175/94; 91/12

[56] References Cited

U.S. PATENT DOCUMENTS

| | | | |
|---|---|---|---|
| 3,407,884 | 10/1968 | Zygmunt et al. | 173/91 |
| 3,727,701 | 4/1973 | Sudnishnikov et al. | 175/19 X |
| 3,744,576 | 7/1973 | Sudnishnikov et al. | 173/91 |
| 3,865,200 | 2/1975 | Schmidt | 175/19 |

*Primary Examiner*—James A. Leppink
*Assistant Examiner*—Richard E. Favreau
*Attorney, Agent, or Firm*—Toren, McGeady and Stanger

[57] ABSTRACT

A self-propelled pneumatic ram boring device for boring holes in the ground comprises a percussion piston which is reciprocable in a housing, and a control sleeve which controls the forward and rearward movement of the piston by passing over radial control ports in the piston. In order to control the device to move either forwards or rearwards, without having to twist a hose which supplies air to the device as is usual, the control sleeve is rigidly fixed in position in the housing and has control ports to which air is supplied or not under the control of valve members and which are themselves remotely controlled by a second compressed air supply to the device, or electrically.

11 Claims, 4 Drawing Figures

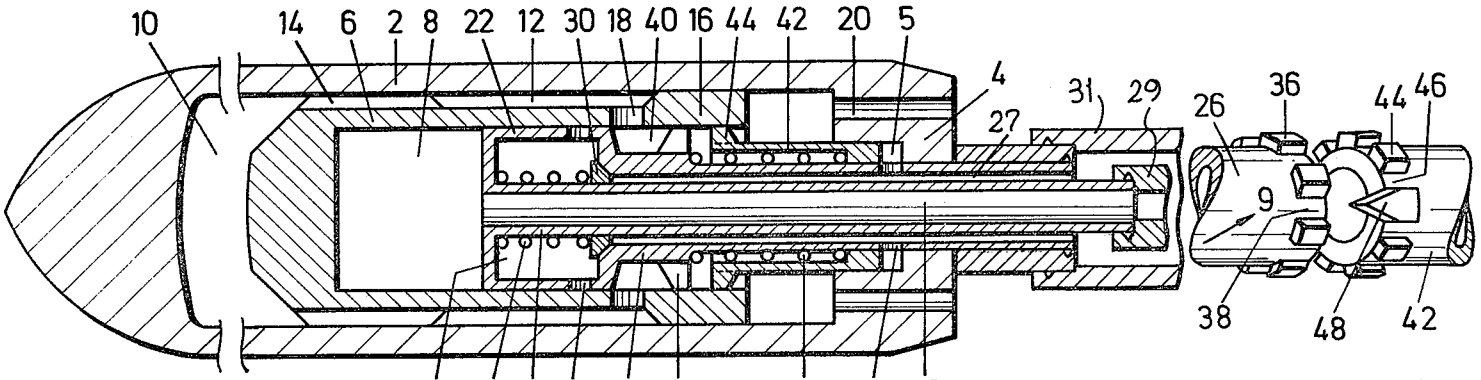
FIG. 1
FIG. 2
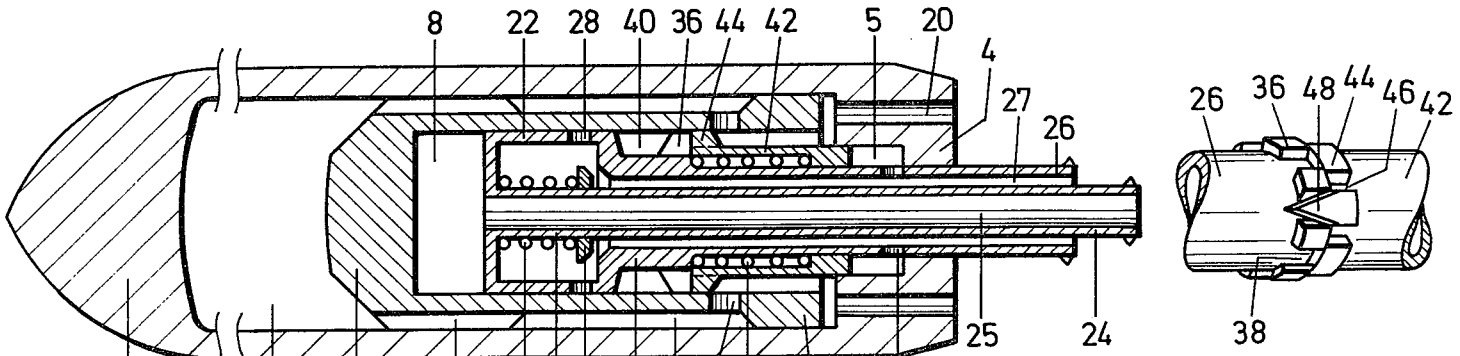
FIG. 3
FIG. 4

PNEUMATIC RAM BORING DEVICE

This invention relates to self-propelled, pneumatic ram boring devices for boring holes in the ground, the device comprising a percussion piston, which is reciprocable in a tubular housing, and a control sleeve which controls the forward and rearward movement of the piston by passing over radial control ports in the percussion piston. The invention is particularly concerned with control valves of such devices.

In a control system known from German Patent Document No. 26 34 066, a compressed air hose by which air is supplied to the device must be rotated through about 90° to reverse the direction of movement of the device in order to rotate a control tube disposed inside the control sleeve and to close specific control ports in the control sleeve and the control tube to bring about either forward or return movement. This control device already overcomes the disadvantage of an earlier control device, known from German Patent specification No. 16 34 417, in which, for the purpose of reversing the device, the control sleeve which extends into a bore having radial openings at the rear end of the percussion piston is axially adjusted by forward and backward screwing of the control sleeve in a screwthreaded flange. This axial adjustment of the control sleeve is effected by rotating several times the compressed air hose connected to the control sleeve. For this purpose the hose must be disconnected from the compressed air source and be rotated through up to fifteen turns until the control sleeve has been screwed in the flange up to a stop. This mode of reversal suffers from the considerable disadvantage that for long lengths of air hose for example from 50 to 80 meters the hose is extremely difficult to rotate. The hose twists as a consequence of its necessary elasticity and has a considerable wall friction with the soil in which the hole is being bored, especially when the soil caves in during the multiple rotation required of the hose. Also, jamming of the control sleeve and/or of the hose can lead to simulation of the limiting position of the control sleeve, when it has actually not been reached. Finally also, the multiple rotation of the hose is time-consuming so that the known reversal control is not suitable for temporary reversal of the forward or return movements, such as is frequently necessary when a device becomes jammed in the soil.

The control system disclosed in German Offenlegungsschrift No. 26 34 066 has, by contrast with the above, the advantage that the compressed air hose only needs to be rotated through about 90° in order to change over from forward to return movement and vice versa. Furthermore, as a consequence of the co-operation of the control sleeve with the control tube, the control ports for the forward and return movement can be disposed in an optimum manner so that the return movement can also be carried out with maximum energy and minimum compressed air consumption.

In this control system also, however, the compressed air hose still has to be moved in the borehole to bring about reversal and this is an operation which can be accompanied by difficulties for large lengths of hose and calls for release of the compressed air hose from the compressed air source. Furthermore, difficulties may be encountered in starting a ram borer over considerable distances in an already constructed borehole, since starting requires a compressed air shock but this may be so damped in a long compressed air line that it is not adequate for producing a renewed jump of the ram borer.

The object of the present invention is so to improve the control system of a ram borer of the type initially described that the compressed air hose or other connections to the ram borer do not need to be moved in order to change over from forward to return movement of the borer and also starting of the ram borer in any position along a borehole is assured.

To this end, according to this invention, in a ram boring device as initially described, the control sleeve is rigidly fixed in position in the housing and has change-over ports which are operated by means of valve members which are adapted to be remotely controlled from outside the housing.

With this arrangement the device may be reversed by means of a control line which lead to the device together with the compressed air hose for driving the device. Only a small amount of energy needs to be supplied to the control line, serving essentially only for actuating the remotely controlled valve members.

The valve members may have electrical actuating means, and the necessary electrical control line may then be embedded in the compressed air hose. The valve members, however, preferably have pneumatic actuating means. This means may be operated by a compressed air line running in parallel with the compressed air hose for driving the device. It may consist of a parallel compressed air line or of a line coaxial with the compressed air line for supplying air to the percussion piston to drive the device. Since the compressed air demand for regulating the valve members is only small, the coaxial compressed air line needs to have a diameter only slightly exceeding that of the main compressed air line for driving the device.

With advantage, one of the valve members controls a compressed air supply to the change-over ports which are disposed radially in a cylindrical head of the control sleeve, and another of the valve members controls the discharge of air through the radial control ports in the percussion piston. In this manner, it is possible to dispose the change-over ports which produce reverse movement of the device in an optimum manner, so that the percussion piston supplies high percussion energy for the reverse movement as well as for the forward movement, and the compressed air consumption is nevertheless small.

The radial change-over ports in the cylindrical head of the control sleeve may lead into a control chamber which is independent of the air duct for operating the piston which leads to a working chamber in front of the control sleeve, the control chamber being connected via one of the valve members to the second compressed air duct. By this arrangement, the compressed air supply to the working chamber which produces the forward movement of the percussion piston and the compressed air supply which causes the return movement of the percussion piston are separated from one another before they reach the percussion piston, so that by suitably choosing the cross-sections and position of the control ports the compressed air comsumption is kept very low.

With advantage, the air duct for operating the piston consists of an inner coaxial tube which passes through the control chamber and the second compressed air duct consists of an outer coaxial tube.

In this manner it is possible for one valve member to be constructed as a spring-loaded annular valve closure member surrounding the inner tube and arranged to close the annular space between the tube. This closure member is held closed by a spring and is opened by compressed air. This makes it possible for the reversal of the device to be effected simply by pressurizing the coaxial outer tube. Additionally, the radial control ports in the percussion piston may lead into an annular space between the piston and the control sleeve and this annular spaces leads to an air venting duct controlled by the said another of the valve members. This annular space is bounded internally by the outer tube, which is bounded at an axial distance from the cylindrical head of the control sleeve with guide webs for the percussion piston, the gaps between the webs being closable by the said another of the valve members.

The control of the outlet air valve may likewise be effected by pressurizing of the outer tube. For this purpose, the said another of the valve members consists of a sleeve which has webs and is axially displaceable on the outer tube. The sleeve is guided internally on the outer tube with which it forms a seal and is guided externally in a flange which closes the rear end of the housing. The outer tube then has radial bores leading into an annular space in the flange behind the sleeve, which is biased by means of a spring towards the flange. By pressurizing the annular space in the flange the sleeve can thus be displaced and opening or closing of the air discharge line can be effected.

In order to prevent the webs on the sleeve from rotating relative to the control sleeve so that closure of the intermediate spaces between the webs would no longer be assured, at least one of the webs on the outer tube or on the sleeve has a centering point which projects into a gap between the webs on the sleeve or on the outer tube respectively.

Satisfactory sealing of the gaps between the webs is assured by the fact that the circumferential width of the webs on the sleeve is at least equal to the width of the gaps between the webs on the outer tube and vice versa.

An example of a ram borer in accordance with the invention is illustrated in the accompanying drawings, in which:

FIG. 1 is a longitudinal section through the ram borer with the control valve in a forward position for producing forward movement of the borer and with a length portion of the housing removed;

FIG. 2 is a perspective view of a control sleeve and a valve sleeve in the forward position;

FIG. 3 is a longitudinal section similar to FIG. 1, through the ram borer with the control valve in a rearward position for producing return movement of the borer; and, FIG. 4 is a perspective view of the control sleeve and the valve sleeve in the rearward position.

The ram borer comprises a cylindrical housing 2, closed at the rear end by a flange 4 and a percussion piston 6 guided to move to and fro in the housing. For this purpose, the percussion piston 6 has at its forward end, that is the left hand end as seen in FIGS. 1 and 3, guide webs 14 and at its rear end a cylindrical guide 16, which forms a seal with the housing. Just in front of the cylindrical guide 16 are radial control ports 18 which provide communication with an annular space 12 between the housing 2 and the percussion piston 6. A working chamber 8 is situated inside the percussion piston 6 in front of a cylindrical head 22 of a control sleeve, which is guided inside and forms a seal with the percussion piston 6. The guide webs 14 create passages for communication between the annular space 12 and a forward pressure chamber 10 ahead of the percussion piston 6. The cylindrical head 22 of the control sleeve continues towards the rear end of the housing 2 in the form of a tube 26, which is rigidly fixed to a flange 4 and projects rearwards beyond this flange where it is connected over coupling means to a compressed air hose 31. An inner tube 24 is situated coaxially in the tube 26. The annular space 27 between the inner tube 24 and the outer tube 26 serves as a compressed air supply duct to a valve chamber 34, which is closable under the action of a compression spring 32 by an annular valve member 30 slidably mounted on the inner tube 24. In the head 22 of the control sleeve, there are further radial control ports 28. Through the inner tube 24 compressed air is supplied to the working chamber 8 by a compressed air hose 29 coupled to the rear end of the inner tube 24.

On the outer tube 26, webs 36 are disposed at an axial distance from the cylindrical head 22, these webs bounding an annular space 40 which as shown in FIG. 1 creates a connection from the annular space 12 via the radial control ports 18 to venting bores 20 in the flange 4 and thence into the atmosphere. A further valve member in the form of a sleeve 42 having webs 44 is axially displaceable on the outer tube 26. The webs 44 enable gaps 38 between the webs 36 to be opened to produce forward movement of the ram borer or to be closed to produce rearward movement. For this purpose, the sleeve 42 is guided and forms a seal in an annular space 5 in the flange 4 and is biased rearwards by a compression spring 50 into the annular space 5. The annular space 5 can be pressurized by compressed air via radial bores 52 in the outer tube 26.

With the annular valve member 30 and the valve member 42, 44 in the positions shown in FIGS. 1 and 2, the annular gap 27 is unpressurized so that the valve member 30 rests on its seating and the webs 44 on the sleeve 42 are situated at a distance from the webs 36 on the outer tube 26. If the bore 25 of the tube 24 is now pressurized, the working chamber 8 fills with compressed air and the percussion piston 6 moves towards the left until it strikes the forward end of the housing 2 or a tool which may be axially displaceably mounted on the end of the housing but is not shown. At this instant, the radial control ports 18 are situated in front of the end face of the cylindrical head 22 of the control sleeve, so that the annular space 12 and the forward pressure chamber 10 are likewise subjected to air under pressure. Since the effective piston area of the percussion piston 6 is greater than the area in the working chamber 8, the percussion piston 6 now moves rearwards until the radial control ports 18 pass over the rear edge of the cylindrical head 22 of the control sleeve and the annular space 12 and the front compression chamber 10 are vented of compressed air via the annular space 40, the gaps 38 and 46 and the vent bores 20. The forward movement of the percussion piston 6 now commences once again in the manner already described.

In order to switch over the movement or to produce rearward movement, the annular gap 27 is pressurized with compressed air so that the annular valve member 30 opens as shown in FIG. 3 and the webs 44 of the sleeve 42 bear against the webs 36 on the tube 26 in such a manner that the gaps 38 and 46 are each closed by corresponding webs 36 and 44. The annular space 12 and the front pressure chamber 10 are already pressurized with compressed air if, in the forward movement of the percussion piston 6, the radial control ports 18 in the percussion piston 6 are situated over the change-over ports 28 in the head 22 of the control sleeve. The rearward movement of the percussion piston 6 is thus initiated before it strikes the forward end of the housing 2, whereas, by contrast, at the end of the rearward movement, the percussion piston 6 strikes the flange 4, since the rearward movement of the percussion piston 6 is not braked by compressed air until the radial control ports 18 in the percussion piston 6 have passed over the webs 36, 44.

In order to prevent the sleeve 42 with its webs 44 from twisting relative to the tube 26 with its webs 36, at least one of the webs 44 is equipped with a centering point 48 which as shown in FIG. 4 projects into a gap 38 between two of the webs 36 and still projects partially into this gap when the sleeve 42 is in its forward position. In FIG. 2, however, the centering point 48 is illustrated as completely withdrawn from the gap 38, in the interests of clarity of the drawing.

By means of the cylindrical head 22 of the control sleeve with the radial control ports 28, and also the cooperation of the webs 36 on the outer tube 26 with the webs 44 on the sleeve 42, optimum conditions are obtained for the forward and return movement of the ram borer together with low air consumption.

Since the energy for actuating the annular valve member 30 and the valve member 42, 44 is supplied through the annular gap 27 no mechanical action upon the ram borer is necessary to reverse its movement so that the ram borer can start up or reverse after a shutdown even inside an already well advanced borehole. For this purpose, the ram borer is initially set in action for rearward movement, since more energy can be supplied through the two compressed air feed lines 25, 27. The annular gap 27 is then isolated from the compressed air source, so that the ram borer automatically changes over to forward movement. The two control valves formed by the members 30 and 36, 44 thus ensure starting up under the control only of air pressure and independently of the length of the borehole and of the hose. In particular they also ensure reversal, for which purpose only one valve is necessary at the compressed air source namely one to supply or shut-off air to the annular gap 27.

I claim:

1. In a self-propelled pneumatic ram boring device for boring holes in the ground, said device comprising a tubular housing, a percussion piston mounted for reciprocating movement in said housing means defining radial control ports in said piston and a control sleeve which is operative to control said reciprocating movement of said piston in dependence upon the passage of said ports over said sleeve, the improvement comprising means rigidly fixing said control sleeve in position in said housing, means defining change-over ports in said control sleeve, passage means for flowing compressed air to said change-over ports, a first valve member cooperating with said control sleeve for interrupting or opening the flow of compressed air through said passage means, means for remotely controlling said first valve member from outside said housing, said means for remotely controlling said first valve member includes pneumatic actuating means for supplying compressed air from outside said housing to said first valve member, a first compressed air duct for the supply of compressed air to reciprocate said piston and drive said device and wherein said pneumatic actuating means includes a second compressed air duct co-axial with said first compressed air duct.

2. A device as claimed in claim 1, wherein said control sleeve includes a cylindrical head, said changeover ports are disposed radially in said cylindrical head, said first valve member controls the supply of compressed air to said change-over ports and a second valve member controls the discharge of air through said control ports in said percussion piston.

3. A device as claimed in claim 2, further comprising means defining a control chamber in said sleeve, said change-over ports in said cylindrical head leading into said control chamber and said control chamber being independent of said first air duct for operating said piston, said piston and control sleeve defining a working chamber in front of said control sleeve, said first air duct communicating with said working chamber and said control chamber communicating via said first valve member with said second air duct.

4. A device as claimed in claim 3, in which said first air duct comprises an inner tube of said co-axial tubes, said inner tube passing through said control chamber and said second duct comprising an outer tube of said co-axial tubes.

5. A device as claimed in claim 4, in which said first valve member comprises an annular valve closure member, spring means loading said valve closure member, said spring means surrounding said inner tube and said closure member being adapted to close an annular space defined between said co-axial tubes.

6. A device as claimed in claim 2, in which an annular space is defined between said piston and said control sleeve, said control ports in said piston communicating with said annular space, means defining an air venting duct controlled by said second valve member and said annular space communicating with said venting duct.

7. A device as claimed in claim 6, in which said first air duct comprises an inner tube of said co-axial tube, said inner tube passing through said control chamber and said second duct comprising an outer tube of said co-axial tube said annular space is bounded internally by said outer tube, and further comprising guide webs on said outer tube, said guide webs being axially spaced from said cylindrical head of said control sleeve and being adapted to guide said piston, said guide webs defining gaps there between, said gaps being closable by said second valve member.

8. A device as claimed in claim 7, in which said second valve member comprises a further sleeve, circumferentially spaced webs projecting from said further sleeve and said further sleeve being axially displaceably mounted on said outer tube.

9. A device as claimed in claim 8, in which said further sleeve is guided internally on said outer tube and further comprising seal means between said further sleeve and said outer tube, said housing having a front end and a rear end, a flange closing the rear end of said housing, said further sleeve in combination with said flange defining a chamber in said flange, said further sleeve being externally guided in said chamber in said flange and said outer tube having radial bores therein, said radial bores in said outer tube leading into said chamber in said flange behind said further sleeve and spring means biasing said further sleeve rearwardly in said chamber in said flange.

10. A device as claimed in claim 8, in which at least one of said webs on one of said outer tube and said further sleeve includes centering point means, said centering point means projecting into one of said gaps between said webs on one of said further sleeve and said outer tube respectively.

11. A device as claimed in claim 8, in which the circumferential width of said webs on said further sleeve is at least as great as the circumferential width of said gaps between said webs on said outer tube and the circumferential width of said webs on said outer tube is at least as great as the circumferential width of said gaps between said webs on said further sleeve.

* * * * *